United States Patent [19]

Leicht et al.

[11] 4,147,467

[45] Apr. 3, 1979

[54] EXHAUST GAS TURBOCHARGER

[75] Inventors: Werner Leicht, Stetten; Georg Ruetz, Immenstaad, both of Fed. Rep. of Germany

[73] Assignee: Motoren- und Turbinen-Union Friedrichshafen GmbH, Fed. Rep. of Germany

[21] Appl. No.: 825,041

[22] Filed: Aug. 16, 1977

[30] Foreign Application Priority Data

Sep. 4, 1976 [DE] Fed. Rep. of Germany ..... 26399837

[51] Int. Cl.[2] ..... F04D 7/02

[52] U.S. Cl. ..... 415/196; 415/205; 415/219 C; 417/407; 60/605

[58] Field of Search ..... 60/605; 415/170 R, 178, 415/196, 202, 205, 213 B, 213 C, 219 B, 219 C; 407/407, 408, 409

[56] References Cited

U.S. PATENT DOCUMENTS

| | | | |
|---|---|---|---|
| 2,911,138 | 11/1959 | Birmann | 417/407 |
| 4,027,994 | 6/1977 | MacInnes | 415/205 |

FOREIGN PATENT DOCUMENTS

| | | | |
|---|---|---|---|
| 2051658 | 5/1972 | Fed. Rep. of Germany | 417/407 |

*Primary Examiner*—C. J. Husar
*Attorney, Agent, or Firm*—Craig & Antonelli

[57] ABSTRACT

An exhaust gas turbocharger for internal combustion engines with a turbine wheel traversed by the exhaust gases radially from the outside toward the inside and with a water-cooled housing; a ring-shaped insert member of heat-resistant steel which is centered in the housing is arranged radially about the turbine wheel between the turbine wheel and the housing, which forms the outer fixed turbine wheel cover and takes over the guidance of the exhaust gases both during the entry and discharge out of the turbine wheel.

10 Claims, 3 Drawing Figures

EXHAUST GAS TURBOCHARGER

The present invention relates to an exhaust gas turbocharger for internal combustion engines with a turbine wheel traversed by the exhaust gases radially from the outside toward the inside and with a water-cooled housing.

Exhaust gas turbochargers are used with internal combustion engines in order to increase the air quantity for a cylinder charge with the aid of the energy contained in the exhaust gases and therewith to achieve a higher output with the same dimensions of the internal combustion engine.

It is thereby necessary to undertake the design of the exhaust gas turbocharger corresponding to the provided point of operation or application of the associated internal combustion engine and corresponding to the type of internal combustion engine.

The matching on the side of the turbine requires with a construction without turbine guide ring an associated turbine housing size for each point of operation or use. With the requirement for a cooled housing construction, this leads to costs for the different turbine housing sizes which are economically hardly still acceptable.

It is therefore the aim of the present invention to so construct a cooled exhaust gas turbocharger that it can be adapted with low expenditures in the best possible manner to the different points of use or operation.

The underlying problems are thereby solved according to the present invention in that between turbine wheel and housing a circularly shaped insert member centered in the housing and made from heat-resistant steel is arranged radially about the turbine wheel, which forms the outer fixed turbine wheel covering and which takes over the guidance and conduction of the exhaust gases during the entry into and discharge out of the turbine wheel.

The insert member can be constructed as spiral with single-flow or double flow corresponding to the provided use or operation of the exhaust gas turbocharger for different turbine output designs whereas the housing and the remaining parts of the exhaust gas turbocharger can be taken over unchanged for a large number of applications.

Additionally, the possibility exists due to the intermediate space resulting between the housing and the insert member which acts as insulation, to cool the housing intensively without an undesirably strong cooling-off of the exhaust gases and without having to accept the heat load on the cooling system connected therewith.

Owing to the use of an insert member of heat-resistant steel, the housing can be made of light metal casting even with stringent requirements for bursting safety.

According to one embodiment of the present invention, the insert member is centered at the first part of a two-partite housing by way of a collar at the housing and a corresponding bore in the insert member and at the second housing part by way of a collar at the insert member and a corresponding bore in the housing, while an axial fixing of the insert member is realized by way of a tubularly shaped exhaust gas inlet connection of the insert member arranged between the two housing parts.

According to another embodiment of the present invention, one or two pipe elbows may be provided in a connecting flange surface arranged at the circumference of a first one of the housing parts, depending on whether the exhaust gas feed is of the single-flow or double-flow type of feed, which establish the connection between the exhaust gas line and the insert member and which are sealingly clamped fast by the assembly of the connecting flange.

According to still another feature of the present invention, one of the housing parts may be constructed as exhaust gas elbow which during the assembly is connected in different pivoted positions with the other housing part corresponding to the requirements of the internal combustion engine.

Accordingly, it is an object of the present invention to provide an exhaust gas turbocharger for internal combustion engines which avoids by simple means the aforementioned shortcomings and drawbacks encountered in the prior art.

Another object of the present invention resides in an exhaust gas turbocharger which can be readily used for different operations and applications without entailing excessive costs.

A further object of the present invention resides in an exhaust gas turbocharger whose turbine housing size can be readily adapted by relatively inexpensive means to different types and applications of the associated internal combustion engine.

Still a further object of the present invention resides in an exhaust gas turbocharger with a cooled housing construction which can be readily adapted with relatively low expenditures to different applications corresponding to different operating conditions of the engine.

Another object of the present invention resides in an exhaust gas turbocharger whose housing can be made of a light-metal casting notwithstanding high requirements as regards safety against bursting.

A further object of the present invention resides in an exhaust gas turbocharger whose housing can be intensively cooled without causing an undesirably large cooling of the exhaust gases.

These and other objects, features and advantages of the present invention will become more apparent from the following description when taken in connection with the accompanying drawing which shows, for purposes of illustration only, two embodiments in accordance with the present invention, and wherein.

Figure 1:
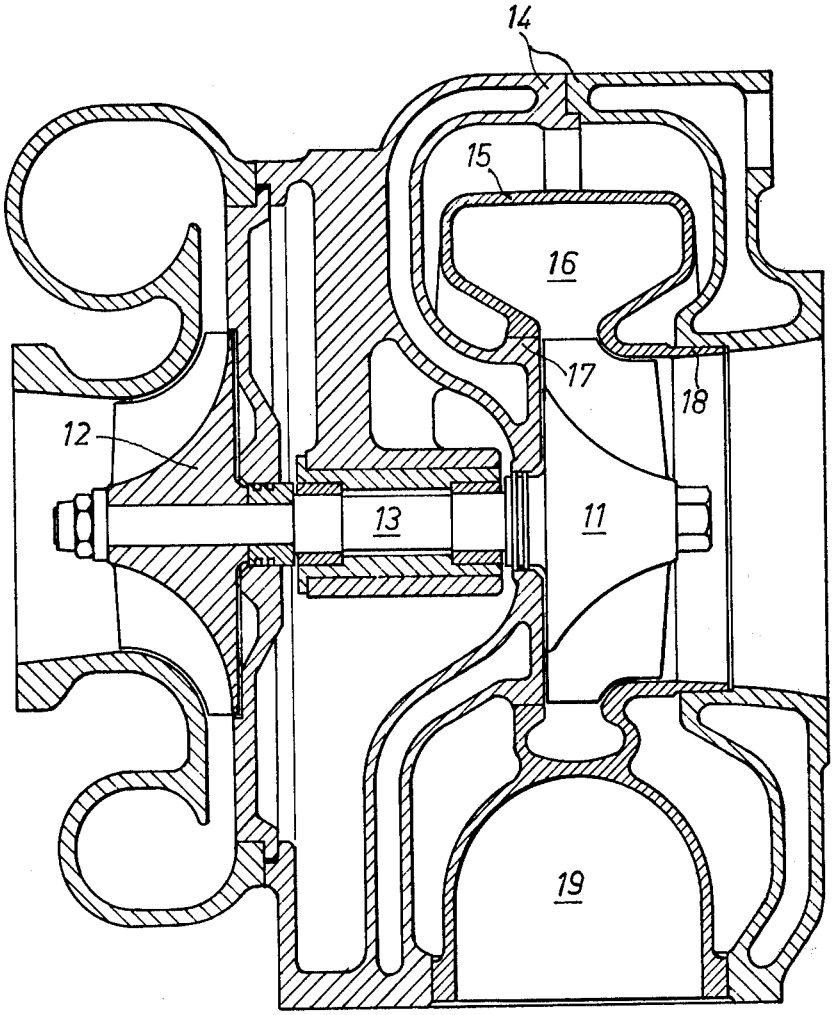
FIG. 1 is a longitudinal cross-sectional view through an exhaust gas turbocharger with a single-flow spiral in accordance with the present invention.

Referring now to the drawing wherein like reference numerals are used throughout the various views to designate like parts, in FIG. 1 the illustrated exhaust gas turbocharger essentially consists of a turbine wheel or rotor 11 and of a compressor wheel or rotor 12. The two bladed wheels 11 and 12 are connected with each other by means of a shaft 13 which is journalled or supported in a housing 14. The housing 14 is subdivided transversely to the axial direction of the exhaust gas turbocharger at the height of the turbine wheel 11. Intermediate the turbine wheel 11 and the housing 14 a circularly shaped insert member 15 of heat-resistant steel is arranged radially about the turbine wheel 11. In the illustrated embodiment, the insert member 15 is constructed as single-flow spiral 16, forms the exhaust gas inlet and the outer fixed turbine wheel covering and takes over the guidance of the exhaust gases during the discharge out of the turbine wheel 11. The centering of the insert member 15 takes place at the first housing half by way of a collar 17 at the housing and by way of a corresponding bore in the insert member and at the second housing half by way of a collar 18 at the insert member 15 and by way of a corresponding bore in the housing. The axial fixing of the insert member 15 takes place by way of the tubularly shaped exhaust gas inlet 19 arranged between the two housing parts. It is assured thereby that the insert member 15 is always securely clamped-in and completely satisfactorily centered during the different expansions of the housing and of the insert member conditioned by different coefficients of expansion and/or the different temperatures to which they are heated up.

Figure 2:
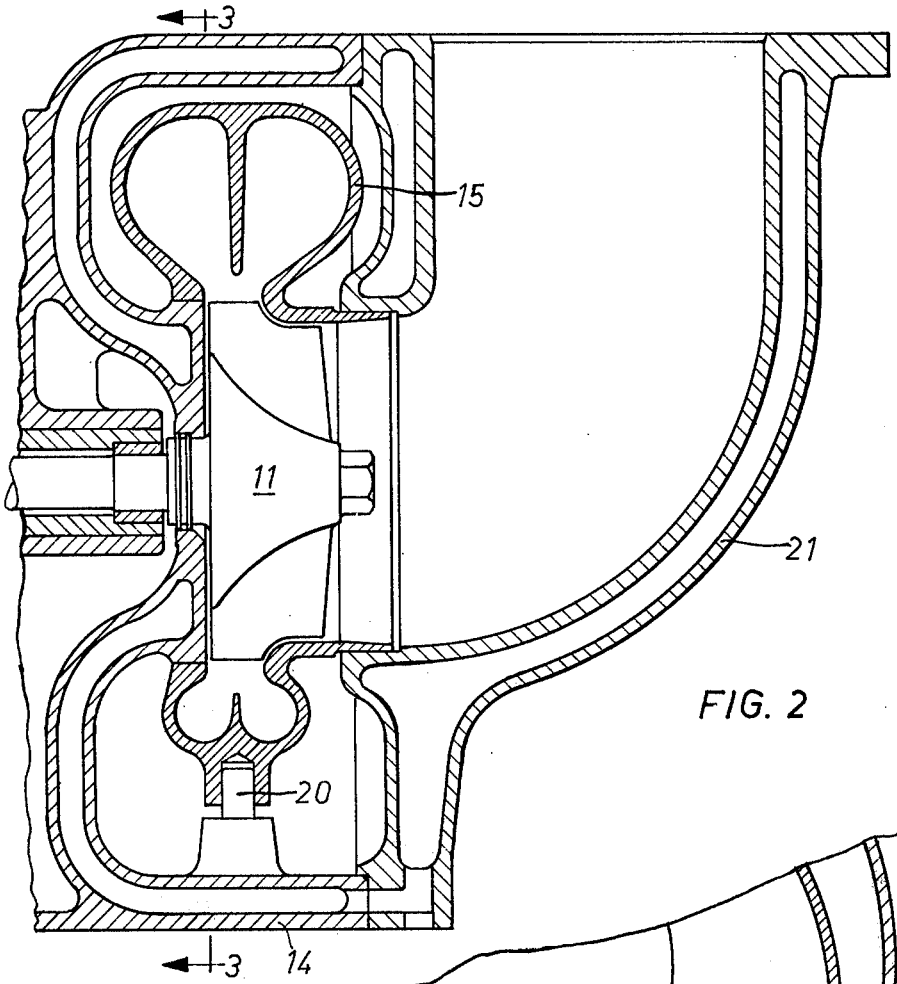
FIG. 2 is a longitudinal cross-sectional view through a turbine of an exhaust gas turbocharger with a double-flow spiral in accordance with the present invention.

In FIG. 2, the housing 14 is subdivided transversely to the axial direction of the exhaust gas turbocharger at the height of the turbine wheel outlet. The insert member 15 is constructed as double-flow spiral and is secured in the axial direction by a bolt 20. The centering takes place in the same manner as in FIG. 1. One housing half is constructed as exhaust gas elbow 21 which during the assembly is selectively connected with the other housing part in different pivoted positions corresponding to the requirements of the internal combustion engine.

Figure 3:
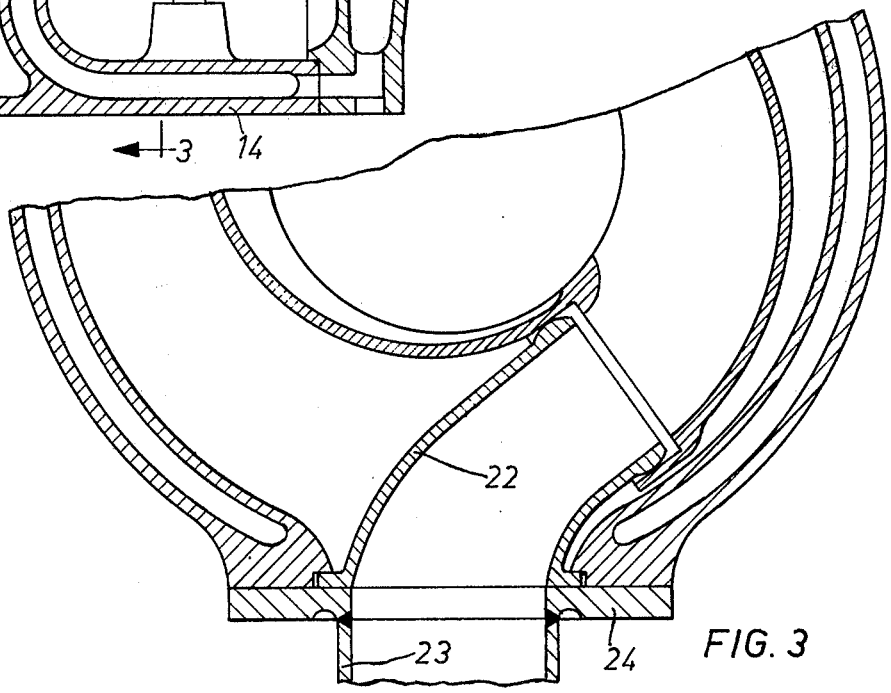
FIG. 3 is a cross-sectional view through the gas connection for one spiral, taken along line 3—3 of FIG. 2.

In FIG. 3, one of two pipe elbows 22 is illustrated which establish the connection between the exhaust gas line 23 and the insert member 15 and which are sealingly clamped fast by the assembly of the connecting flange 24.

While we have shown and described only two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An exhaust gas turbocharger for internal combustion engines, comprising a turbine wheel means traversed by exhaust gases radially from the outside toward the inside and a water-cooled housing means, characterized in that an insert means of heat-resistant steel which is of annular shape is arranged radially about the turbine wheel means between the turbine wheel means and the housing means, said insert means forming the outer fixed turbine covering and taking over the guidance of the exhaust gases during entry into and discharge out of the turbine wheel means.

2. An exhaust gas turbocharger according to claim 1, characterized in that the insert means is centered in the housing means.

3. An exhaust gas turbocharger according to claim 1, with a housing means subdivided transversely to the axial direction of the exhaust gas turbocharger substantially at the height of the turbine wheel means, characterized in that the insert means is centered at a first housing part by way of a collar at the housing means and by way of a corresponding bore in the insert means and at another housing part by way of a collar at the insert means and by way of a corresponding bore in the housing means.

4. An exhaust gas turbocharger according to claim 3, characterized in that the insert means is axially fixed by way of a tubularly shaped exhaust gas inlet connection means of the insert means arranged between the two housing parts.

5. An exhaust gas turbocharger according to claim 1, with a housing means subdivided substantially transversely to the axial direction of the exhaust gas turbocharger at the height of the turbine wheel discharge, characterized in that at least one pipe elbow means is inserted in a connection flange surface means arranged along the circumference of a first housing part, which establishes the connection between the exhaust gas line and the insert means.

6. An exhaust gas turbocharger according to claim 5, characterized in that the pipe elbow means is sealingly clamped fast by the assembly of a connecting flange.

7. An exhaust gas turbocharger according to claim 5, characterized in that the pipe elbow means is directly secured at the housing means.

8. An exhaust gas turbocharger means according to claim 5, characterized in that only one pipe elbow means is provided for a single-flow exhaust gas feed.

9. An exhaust gas turbocharger means according to claim 5, characterized in that two pipe elbow means are provided for a double-flow exhaust gas feed.

10. An exhaust gas turbocharger according to claim 5, characterized in that one housing part is constructed as exhaust gas elbow which during the assembly is selectively connected with the other housing part in different pivoted positions corresponding to the requirements of the internal combustion engine.

* * * * *